United States Patent [19]

Hirsch

[11] 4,364,293

[45] Dec. 21, 1982

[54] ROTARY KNIFE HOLDER WITH MEANS FOR DAMPING ITS NATURAL FREQUENCY OSCILLATIONS

[75] Inventor: Gerhard Hirsch, Aachen, Fed. Rep. of Germany

[73] Assignee: E. C. H. Will (GmbH & Co.), Hamburg, Fed. Rep. of Germany

[21] Appl. No.: 152,185

[22] Filed: May 22, 1980

[30] Foreign Application Priority Data

Jun. 9, 1979 [DE] Fed. Rep. of Germany ..... 2923516

[51] Int. Cl.[3] ..... B26D 1/56

[52] U.S. Cl. ..... 83/674; 83/331; 83/665; 267/137

[58] Field of Search ..... 51/169; 74/574; 83/469, 83/491, 663, 665, 676, 701, 331, 674; 181/207; 267/137

[56] References Cited

U.S. PATENT DOCUMENTS 2,001,167 5/1935 Swennes ..... 181/207
2,736,393 2/1956 O'Connor ..... 74/574
3,075,406 1/1963 Butler et al. ..... 74/574
3,845,827 11/1974 Schulin ..... 267/137

FOREIGN PATENT DOCUMENTS 555010 5/1977 U.S.S.R. ..... 83/663

*Primary Examiner*—Stephen G. Kunin
*Assistant Examiner*—K. Bradford Adolphson
*Attorney, Agent, or Firm*—Kontler, Grimes & Battersby

[57] ABSTRACT

A rotary knife holder which is used in a transverse cutter for running paper webs or the like has a tubular carrier with an axial bore for a dynamic damping system serving to damp the natural frequency oscillations of the carrier. The damping system has a cylindrical mass whose end portions are surrounded by elastic annuli installed in a sleeve which is fixedly installed in the axial bore of the carrier. The natural frequency of the damping system is attuned to the natural frequency of the carrier. If the carrier is journalled at both ends, the damping system is installed midway between the ends of the carrier.

6 Claims, 2 Drawing Figures

ROTARY KNIFE HOLDER WITH MEANS FOR DAMPING ITS NATURAL FREQUENCY OSCILLATIONS

BACKGROUND OF THE INVENTION

The present invention relates to rotary knife holders in general, and more particularly to improvements in rotary holders for knives which can be used in apparatus for severing sheet stock, such as running webs or strips consisting of paper, cardboard, metallic foil, plastic foil or the like. Still more particularly, the invention relates to improvements in means for damping the oscillations of rotary knife holders.

Apparatus for severing running webs or strips of paper or the like utilize one or more rotary holders for knives which extend transversely of the path of the running web or webs and sever the web or webs once during each revolution of the holder or holders. In many instances, apparatus of the just outlined character (also known as transverse cutters) employ two rotary knife holders, one at each side of the path along which the web or webs are transported lengthwise. Each knife of one holder cooperates with a different knife of the other holder to sever the web or webs in the region where the web or webs pass through the nip of the two holders. It is also known to employ a stationary knife holder at one side and a rotary holder with one or more knives at the other side of the path of transport of one or more webs. If the apparatus uses two rotary holders, the peripheral speed of such holders (such rotate in opposite directions) matches the speed of forward movement of the web or webs (at least during the intervals of severing). Apparatus of such type are known as parallel transverse cutters.

The peripheral speed of the rotary holder or holders (i.e., the speed of the cutting edge or edges of one or more orbiting knives) varies in dependency on changes of the speed of lengthwise movement of the web or webs. Thus, the peripheral speed of the holder or holders increases with increasing forward speed of the material which is to be severed to yield sheets of desired length. As a rule, the manufacturer will wish to operate the severing apparatus at or close to the maximum capacity, especially if such apparatus forms part of a production line wherein wide webs are subdivided into narrower webs or strips which are thereupon subdivided into discrete sheets preparatory to stacking of such sheets and conversion of stacks into note books, steno pads, exercise books or like stationery products.

It has been found that, when the peripheral speed of the rotary knife holder or holders reaches a certain threshold value, the knife or knives are likely to "skip", i.e., they fail to sever the running web or webs. The failure can be complete (namely, the knife or knives do not sever any part of the web or webs) or partial (thus, the knives can score the web or webs or even partially sever the web or webs but the severing action does not suffice to form a series of discrete sheets). The so-called skipping can also amount to inferior cuts, i.e., the cuts across the running web or webs are complete but not clean so that the resulting discrete sheets exhibit ragged edges and cannot be properly stacked and/or otherwise processed.

Experiments with presently known transverse cutters indicate that the just discussed skipping is attributable to oscillation of the rotary knife holders. Thus, when the knife on a holder severs a web, the severing action is felt by the respective holder in the form of an impact which initiates oscillatory movements. If the peripheral speed of a knife holder is constant, the oscillatory movements are attributable to flexing of the holder, i.e., vibrations which are attributable to torsional stresses are negligible or non-existent. However, the torsional stresses are or can be sufficiently pronounced to cause readily detectable oscillations of the knife holder if the latter is driven at a variable speed. When the speed of the holder exceeds the aforementioned threshold value, oscillations which are attributable to torsional stresses and/or bending are sufficiently pronounced so as not to disappear during the interval between two successive cuts across the running web or webs. This compounds the problems and often or invariably causes skipping which can be discerned due to total absence of cuts or due to the making of inferior cuts. In other words, the positions of cooperating knives on two rotary holders or a rotary and a stationary holder can or will vary from severing action to severing action if the speed of the knife holder or holders reaches or exceeds the threshold value, and the unpredictability of positioning of the knife holder or holders during successive severing steps increases if the speed of the holder or holders is not constant. If the frequency and/or amplitude of oscillations is excessive, at least one of the holders is likely to move the cutting edge of its knife away from the cutting edge of the other knife at the exact moment when the knives are to sever the running web or webs with the aforementioned result that the current edges will fail to sever the web or webs or will perform an unsatisfactory severing action.

An analysis of the just discussed phenomena can be found in the German-language publication entitled "Messtechnische Briefe" 2 (1969), pages 35–39. The just mentioned article refers to the possibility of remedying the situation by regulating the behavior of knife holders but fails to furnish any concrete solutions.

OBJECTS AND SUMMARY OF THE INVENTION

An object of the invention is to provide a novel and improved rotary knife holder which is constructed and assembled in such a way that it cannot or is less likely to adversely influence the severing action of its knife or knives regardless of whether the holder is driven at a constant or variable speed and/or at a high or low speed.

Another object of the invention is to provide the holder with novel and improved means for reducing or eliminating the influence of natural oscillations upon the severing action of the knife or knives which are orbited by the holder.

A further object of the invention is to provide novel and improved means for counteracting the effects of speed- and/or speed change-induced oscillations of rotary knife holders upon the quality of severing action which is performed by the knife or knives on or in such holders.

An additional object of the invention is to provide a rotary knife holder which exhibits the above outlined features and can be installed in existing transverse cutters or analogous severing apparatus as a superior substitute for existing knife holders.

A further object of the invention is to provide a relatively simple and inexpensive knife holder which is constructed and assembled in such a way that it can shield the knife or knives therein from adverse influence of flexure- and/or torsion-induced oscillations of the holder.

Another object of the invention is to provide a knife holder which ensures satisfactory guidance of the knife or knives thereon regardless of whether its peripheral speed is constant or varies during each and every revolution thereof.

The invention is embodied in a knife holder, particularly in a holder for use in apparatus for subdividing one or more running webs or strips consisting of paper, cardboard, metallic foil, plastic foil or the like into discrete sheets. The holder comprises a hollow rotary carrier or support which may include or constitute a tube having an axial passage and tending to oscillate at a given natural frequency, and means for damping the oscillations of the carrier. The damping means comprises a dynamic damping system which is disposed in the interior of the carrier and has a natural oscillation frequency which is attuned to the given natural oscillation frequency of the carrier. The dynamic damping system can be installed in the aforementioned axial passage midway between the axial ends of the tube if the carrier is journalled at both ends so that the region or portion of maximum flexibility of the carrier is located centrally between the two ends thereof.

The dynamic damping system can comprise a mass (e.g., a metallic component which is or includes a cylinder) and means for coupling the mass to the carrier so that the mass is free to oscillate relative to the carrier. The coupling means preferably comprises at least one elastic element which is interposed between the mass and the carrier. For example, the coupling means may include two annuli consisting (at least in part) of elastomeric material and surrounding the end portions of the aforementioned cylinder. Such annuli can be mounted directly in the carrier or in a sleeve which is coaxial with and is installed in the interior of the carrier. For example, the sleeve can be fixedly (but preferably releasably) secured to the carrier by one or more screws, bolts or analogous fastener means.

The elastic element or elements may be made of rubber, other elastomeric material or a filamentary metallic material. In the latter instance, each elastic element may constitute an annular cushion which consists, in its entirety, of metallic material.

The novel features which are considered as characteristic of the invention are set forth in particular in the appended claims. The improved knife holder itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
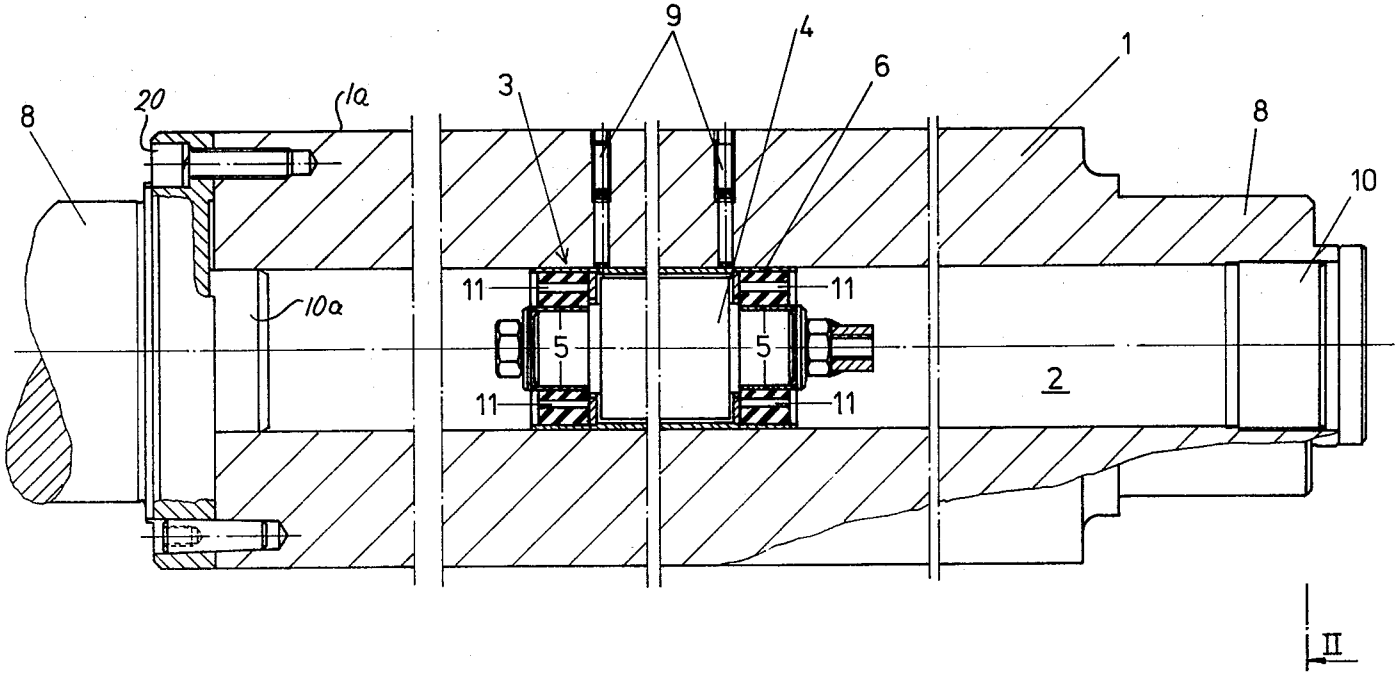
FIG. 1 is a fragmentary partly elevational and partly axial sectional view of a rotary knife holder which is constructed and assembled in accordance with the present invention.
Figure 2:
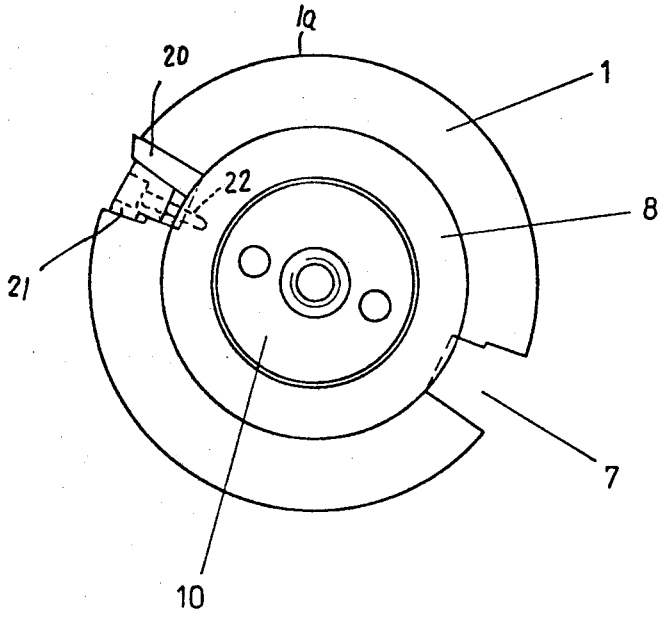
FIG. 2 is an end elevational view of the knife holder as seen from the right-hand side of FIG. 1.

The rotary knife holder which is shown in FIGS. 1 and 2 comprises a drum-shaped hollow tubular carrier 1 having an axial passage 2 for a dynamic damping system 3. The peripheral surface 1*a* of the carrier 1 is formed with two elongated recesses 7 which extend in parallelism with the axis of the passage 2 and serve for reception and retention of knives, not shown. The manner in which the knives are installed in the recesses 7 can be the same as or similar to that disclosed in the commonly owned copending application Ser. No. 333,104 filed Dec. 21, 1981 which is a continuation of Ser. No. 144,029 filed Apr. 28, 1980 by Harold Rann for "Apparatus for severing running paper webs or the like". As can be seen in FIG. 2, a knife 20 extends into one of the recesses 7 and is held therein by a wedge-like retaining element 21 which is inserted into the respective recess 7 and is separably secured to the carrier 1 by a row of threaded fasteners 22 (only one shown) Alternatively, the knives can be installed and held in their respective recesses in any one of presently known conventional ways.

The holder including the carrier 1 forms part of a transverse cutter for running webs of paper or the like. For example, the transverse cutter may be of the type shown in FIG. 1 of the aforementioned application Ser. No. 333,104 of Rann. The end portions 8 of the carrier 1 constitute trunnions which are journalled in suitable bearings (e.g., roller bearings, not shown) in the frame of a paper processing machine. The means for rotating the carrier 1 through the medium of the one and/or the other trunnion 8 and/or through the medium of a device which transmits torque to the larger-diameter median portion of the carrier is not shown in the drawing. As explained above, the carrier 1 can be driven at a constant speed or at a speed which varies during each revolution.

The dynamic damping system 3 in the central portion of the axial passage 2 is designed to counteract natural frequency oscillations of the carrier 1. The damping system 3 includes a mass 4 which is a cylinder having smaller-diameter end portions, and means for coupling the mass 4 to the carrier 1 in such a way that the mass is free to oscillate relative to the carrier. The coupling means includes two annular elastic elements 5 which surround the respective smaller-diameter end portions of the mass 4, and an elongated cylindrical sleeve 6 which is snugly inserted into the central portion of the axial passage 2 and is fixedly but releasably held against movement relative to the carrier 1 by one or more fasteners 9 in the form of screws or bolts whose shanks mesh with the carrier, which extend radially of the carrier, and whose tips bear against the sleeve 6.

The elastic elements 5 may consist of rubber or a similar elastomeric material. These elements are rings which fit onto the smaller-diameter end portions of the mass 4 and maintain the latter at a fixed distance from the internal surface of the sleeve 6. The elements 5 ensure that the mass 4 is free to oscillate, at its natural frequency, relative to the carrier 1 and vice versa.

It is also possible to replace the elastic annular elements 5 with annular elements which consist, in their entirety, of a metallic material. For example, the elements 5 may be replaced by elastic elements consisting (entirely or in part) of metallic filaments which form cushions for the mass 4. Such cushions are manufactured and sold by the German firm Stop-Choc of Magstadt.

It is presently preferred to assemble the entire dynamic damping system 3 as a self-sustaining unit which is thereupon inserted into the carrier 1. Thus, the elastic elements 5 can be mounted on the end portions of the mass 4 and inserted into the sleeve 6 before the latter is introduced into the passage 2 of and affixed to the carrier 1 by fasteners 9 or analogous securing means. Assembly of the entire dynamic damping system 3 as a self-sustaining unit is desirable because this renders it possible to properly select the natural frequency of the system 3 and to attune it to the natural frequency of the carrier 1, and also because the system 3 can be assembled at a reduced cost. Once the accurately tuned system 3 is properly installed in the passage 2, the open ends of this passage are closed and preferably sealed by plugs 10 or the like. In the illustrated embodiment, one end of the passage 2 is sealable by a plug 10. The other end of the passage 2 is sealed by a plug 10*a* which forms an integral part of and is detachable together with the corresponding trunnion 8. The latter is separably secured to the central or main body portion of the carrier 1 by several screws 20.

In the absence of the damping system 3, oscillations which are induced whenever a knife severs the running web could or would persist during the entire interval between the just mentioned and the next following severing operation. Such relatively long periods of oscillation of the carrier 1 are especially troublesome if the holder is driven at a high speed (i.e., if the web or webs are moved lengthwise at an elevated speed) so that the interval which the holder requires to complete a full revolution (or one-half of a revolution if the carrier 1 supports two knives) is longer than the period of natural or characteristic frequency oscillation of the carrier. It has been found that the improved damping system 3 rapidly damps oscillatory movements of the carrier 1 so that such movements are terminated or reduced to a negligible value before the next knife engages the running web or webs. The term "negligible value" is intended to denote oscillations of such magnitude that they cannot adversely influence the severing action of the knife or knives, i.e., each knife can completely sever the web and the cut is clean as long as the cutting edge is sharp and is properly aligned with the cutting edge of the cooperating (stationary or orbiting) knife. In other words, failure of the knife or knives to make satisfactory cuts should not be attributable to the tendency of the carrier or carriers to oscillate as a result of engagement of knives with the web or webs and/or with each other.

It has been found that the damping action of the system 3 is improved if its natural frequency is optimally attuned to the natural frequency of the carrier 1. This can be readily achieved by proper selection of dimensions and/or material of the mass 4 and/or by appropriate selection of spring constants of the elastic elements 5 in the coupling means between the mass 4 and the carrier 1. If the elastic elements 5 are annuli or rings or discs made of rubber, their oscillations can be readily controlled by appropriate selection of the elastomeric material and/or by appropriate configuration (dimensioning) of such components. For example, the characteristics of elements 5 can be influenced by drilling or otherwise forming therein annuli of bores 11 whose axes are parallel to the common axis of the elements 5, sleeve 6, carrier 1 and cylinder of the mass 4. Each annulus of bores 11 surrounds the respective end portion of the mass 4. Elastic elements which can be used in the damping system of the present invention preferably exhibit pronounced damping characteristics.

As mentioned above, oscillations of the carrier 1 will be attributable primarily to bending if the carrier is driven at a constant or nearly constant speed. If both ends of the carrier 1 are journalled in the frame of a paper processing or like machine, the maximum bending takes place midway between the trunnions 8. Therefore, the damping system 3 is preferably installed in the central portion of the passage 2, i.e., midway between the two trunnions. Otherwise stated, the system 3 is installed in the region of maximum amplitude of flexure-induced oscillations of the carrier 1.

It is already known to employ dynamic damping systems which comprise a mass and a damping spring. Such systems are used in certain parts of various machines to damp machine-imparted (not natural-frequency) oscillatory movements in regions where such movements are undesirable or harmful. The presently known damping systems are not used to eliminate or reduce characteristic or natural frequency oscillations of oscillatable components, and much less for prevention or reduction of natural frequency oscillations which are induced by flexing of and/or torsional stresses upon rotary components which are or constitute shafts, holders for orbiting knives or the like. Additional advantages of the improved holder are attributable to the aforedescribed specific design of the illustrated damping system 3 and to its installation in the interior of a hollow carrier for one or more orbiting knives. Such construction contributes to reliability, simplicity, lower cost and compactness of the knife holder. It has been found that the improved holder ensures satisfactory severing action regardless of the speed of lengthwise movement of the web or webs, regardless of whether such speed is constant or fluctuates within a wide or narrow range, and regardless of whether the tendency of the carrier to oscillate is attributable to torsional and/or bending stresses. In each instance, the system damps oscillatory movements during the interval which elapses between two successive cutting actions to such an extent that the oscillations (if any) which are observable during severing cannot adversely influence the cutting operation. This is especially desirable in modern high-speed production lines which are used to turn out steno pads, exercise books or the like. In such production lines, even short lasting interruptions for the purpose of inspecting and/or adjusting and/or replacing one or more knives and/or their holders would entail substantial losses in output.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A knife holder, particularly for use in apparatus for subdividing a running web of paper or the like into discrete sheets, comprising a hollow rotary carrier which tends to oscillate at a given natural frequency, said carrier having an axial passage, at least one peripheral recess extending in substantial parallelism with the axis thereof, and at least one knife, a portion of which extends into and is retained within said at least one peripheral recess; means for damping the oscillations of said carrier, including a dynamic damping unit disposed in the passage of said carrier and having a natural frequency which is attuned to said given frequency, said unit comprising a mass and means for coupling said mass to said carrier so that the mass is free to oscillate relative to said carrier, said mass comprising a cylinder and said coupling means comprising a plurality of elastic elements interposed between said cylinder and said carrier, said coupling means further comprising a sleeve coaxial with and installed in the interior of said carrier, said cylinder being installed in, being normally coaxial with and being freely oscillatable relative to said sleeve and said elastic elements being interposed between said sleeve and said cylinder.

2. The holder of claim 1, further comprising means for fixedly securing said sleeve to said carrier.

3. The holder of claim 1, wherein each of said elastic elements includes an annulus consisting at least in part of elastomeric material.

4. The holder of claim 1, wherein said carrier is flexible and includes a portion of maximum flexibility, said unit being installed in said portion of said carrier.

5. The holder of claim 4, wherein said carrier is an elongated tube having first and second end portions and said portion of maximum flexibility is disposed substantially midway between said end portions.

6. The holder of claim 1, wherein said axial passage is open at least at one end thereof, and further comprising means for closing said end of said passage.

* * * * *